US010138708B2

(12) United States Patent
Williamson, Jr. et al.

(10) Patent No.: US 10,138,708 B2
(45) Date of Patent: Nov. 27, 2018

(54) REMOTELY OPERATED PRODUCTION VALVE

(71) Applicant: HALLIBURTON ENERGY SERVICES, INC., Houston, TX (US)

(72) Inventors: Jimmie R. Williamson, Jr., Carrollton, TX (US); James D. Vick, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/589,675

(22) Filed: May 8, 2017

(65) Prior Publication Data

US 2017/0241237 A1 Aug. 24, 2017

Related U.S. Application Data

(60) Division of application No. 14/094,315, filed on Dec. 2, 2013, now Pat. No. 9,650,864, which is a (Continued)

(51) Int. Cl.
*E21B 23/00* (2006.01)
*E21B 34/14* (2006.01)
(Continued)

(52) U.S. Cl.
CPC ..... *E21B 34/102* (2013.01); *E21B 34/08* (2013.01); *E21B 43/04* (2013.01); *E21B 43/14* (2013.01);
(Continued)

(58) Field of Classification Search
CPC .. E21B 23/00; E21B 34/102; E21B 2034/007; E21B 34/14
See application file for complete search history.

(56) References Cited

U.S. PATENT DOCUMENTS 3,990,511 A 11/1976 Gazda
4,475,599 A 10/1984 Akkerman
(Continued)

FOREIGN PATENT DOCUMENTS

WO WO-2009132462 A1 11/2009
WO WO-2010127457 A1 11/2010

OTHER PUBLICATIONS

International Search Report dated Aug. 7, 2012 for International Application No. PCT/US12/23321, 5 pages.
(Continued)

*Primary Examiner* — Catherine Loikith
(74) *Attorney, Agent, or Firm* — Locke Lord LLP

(57) ABSTRACT

A method of actuating multiple valves in a well can include applying a pressure cycle to the valves without causing actuation of any of the valves, and then simultaneously reducing pressure applied to the valves, thereby actuating the valves. Another method can include releasing a locking device of each valve which prevents actuation, and then reducing pressure applied to the valves, thereby actuating the valves. A valve can include a port which provides for fluid communication between an exterior and an interior of the valve, a closure member which selectively permits and prevents fluid flow through the port, the closure member permits flow through the port in response to a decrease in a pressure differential from the interior to the exterior of the valve, and a locking device which prevents displacement of the closure member, the locking device being released in response to mechanical force applied to the locking device.

7 Claims, 8 Drawing Sheets

Related U.S. Application Data continuation of application No. 13/031,551, filed on Feb. 21, 2011, now Pat. No. 8,662,179.

(51) Int. Cl.

| | |
|---|---|
| ***E21B 34/10*** | (2006.01) |
| ***E21B 34/08*** | (2006.01) |
| *E21B 34/00* | (2006.01) |
| *E21B 43/04* | (2006.01) |
| *E21B 43/14* | (2006.01) |
| *E21B 43/26* | (2006.01) |

(52) U.S. Cl.

CPC ..... *E21B 43/26* (2013.01); *E21B 2034/007* (2013.01)

(56) References Cited

U.S. PATENT DOCUMENTS

| | | | | |
|---|---|---|---|---|
| 6,173,795 | B1 | 1/2001 | McGarian et al. | |
| 6,230,807 | B1 | 5/2001 | Patel | |
| 6,241,015 | B1 | 6/2001 | Pringle et al. | |
| 6,397,949 | B1 | 6/2002 | Walker et al. | |
| 6,644,412 | B2 | 11/2003 | Bode et al. | |
| 6,684,950 | B2 | 2/2004 | Patel | |
| 7,210,534 | B2 | 5/2007 | Hayter et al. | |
| 7,290,610 | B2 * | 11/2007 | Corbett | E21B 34/06 166/278 |
| 8,596,365 | B2 | 12/2013 | Frosell | |
| 8,596,368 | B2 | 12/2013 | Frosell | |
| 2001/0042626 | A1 | 11/2001 | Patel | |
| 2002/0066573 | A1 | 6/2002 | Patel | |
| 2002/0112862 | A1 | 8/2002 | Patel | |
| 2007/0251697 | A1 | 11/2007 | Loretz et al. | |
| 2009/0272539 | A1 | 11/2009 | Lloyd et al. | |
| 2011/0100643 | A1 | 5/2011 | Themig et al. | |
| 2012/0199364 | A1 | 8/2012 | Frosell | |
| 2012/0211241 | A1 | 8/2012 | Williamson, Jr. et al. | |

OTHER PUBLICATIONS

Written Opinion dated Aug. 7, 2012 for International Application No. PCT/US12/23321, 4 pages.

International Search Report with Written Opinion dated Aug. 7, 2012 for International Application No. PCT/US12/021949, 9 pages.

* cited by examiner

REMOTELY OPERATED PRODUCTION VALVE

CROSS-REFERENCE TO RELATED APPLICATIONS

This patent application is a Divisional application of U.S. patent application Ser. No. 14/094,315, titled "REMOTELY OPERATED PRODUCTION VALVE AND METHOD", filed on Dec. 2, 2013; which is a Continuation of U.S. patent application Ser. No. 13/031,551 filed Feb. 21, 2011, now U.S. Pat. No. 8,662,179, issued on Mar. 3, 2014. The entire contents of these applications are incorporated herein by reference in their entirety.

BACKGROUND

This disclosure relates generally to equipment utilized and procedures performed in conjunction with a subterranean well and, in an example described below, more particularly provides a remotely operated production valve.

Pressure-operated valves used in downhole environments have an advantage, in that they can be operated remotely, that is, without intervention into a well with a wireline, slickline, coiled tubing, etc. However, a conventional pressure-operated valve can also respond to applications of pressure which are not intended for operation of the valve, and so it is possible that the valve can be operated inadvertently.

Therefore, it will be appreciated that it would be desirable to prevent inadvertent operation of a remotely operated valve.

SUMMARY

In the disclosure below, a well system, method and valve are provided which bring improvements to the art of operating valves in well environments. One example is described below in which the valve can be actuated remotely after any number of pressure cycles have been applied to the valve. Another example is described below in which multiple valves can be opened in response to reducing pressure applied to the valves.

In one aspect, a method of actuating multiple valves in a well is described below. The method can include applying at least one pressure cycle to the valves without causing actuation of any of the valves, and then simultaneously reducing pressure applied to the valves, thereby actuating the valves.

In another aspect, a method of actuating multiple valves in a well can include applying at least one pressure cycle to the valves without causing actuation of any of the valves; then releasing a locking device of each valve which prevents actuation of each valve; and then reducing pressure applied to the valves, thereby actuating the valves.

A remotely operated valve for use with a subterranean well is also described below. The valve can include a port which provides for fluid communication between an exterior and an interior of the valve; a closure member which selectively permits and prevents fluid flow through the port, the closure member permits flow through the port in response to a decrease in a pressure differential from the interior to the exterior of the valve; and a locking device which prevents displacement of the closure member, the locking device being released in response to mechanical force applied to the locking device.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
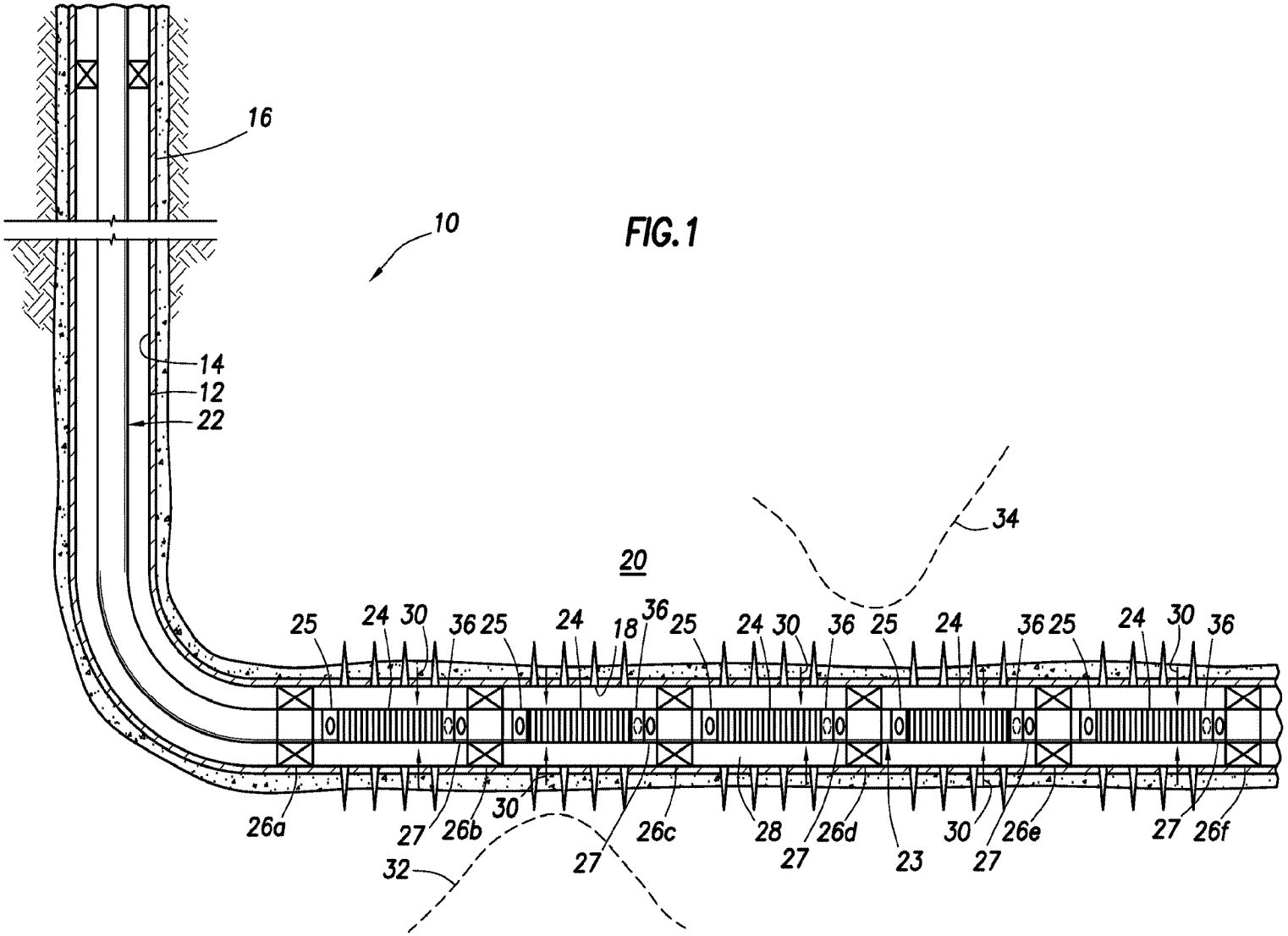
FIG. 1 is a representative partially cross-sectional view of a well system and associated method which can embody principles of the present disclosure.

Representatively illustrated in FIG. 1 is a well system 10 and associated method which can embody principles of this disclosure. In this example, a wellbore 12 has a generally vertical section 14, and a generally horizontal section 18 extending through an earth formation 20.

A tubular string 22 (such as a production tubing string, or upper completion string) is installed in the wellbore 12. The tubular string 22 is stabbed into a gravel packing packer 26*a*.

The packer 26*a* is part of a generally tubular completion string 23 which also includes multiple well screens 24, valves 25, isolation packers 26*b-e*, and a sump packer 26*f*. Valves 27 are also interconnected in the completion string 23.

The packers 26*a-f* seal off an annulus 28 formed radially between the tubular string 22 and the wellbore section 18. In this manner, fluids 30 may be produced from multiple intervals or zones of the formation 20 via isolated portions of the annulus 28 between adjacent pairs of the packers 26*a-f*.

Positioned between each adjacent pair of the packers 26*a-f*, at least one well screen 24 and the valves 25, 27 are interconnected in the tubular string 22. The well screen 24 filters the fluids 30 flowing into the tubular string 22 from the annulus 28.

At this point, it should be noted that the well system 10 is illustrated in the drawings and is described herein as merely one example of a wide variety of well systems in which the principles of this disclosure can be utilized. It should be clearly understood that the principles of this disclosure are not limited at all to any of the details of the well system 10, or components thereof, depicted in the drawings or described herein.

For example, it is not necessary in keeping with the principles of this disclosure for the wellbore 12 to include a generally vertical wellbore section 14 or a generally horizontal wellbore section 18. It is not necessary for fluids 30 to be only produced from the formation 20 since, in other examples, fluids could be injected into a formation, fluids could be both injected into and produced from a formation, etc.

It is not necessary for one each of the well screen 24 and valves 25, 27 to be positioned between each adjacent pair of the packers 26*a-f*. It is not necessary for a single valve 25 or 27 to be used in conjunction with a single well screen 24. Any number, arrangement and/or combination of these components may be used.

It is not necessary for the well screens 24, valves 25, 27, packers 26*a-f* or any other components of the tubular string 22 to be positioned in cased sections 14, 18 of the wellbore 12. Any section of the wellbore 12 may be cased or uncased, and any portion of the tubular string 22 or completion string 23 may be positioned in an uncased or cased section of the wellbore, in keeping with the principles of this disclosure.

It is not necessary for the tubular string 22 to be used for producing the fluid 30 from the formation 20. Fluid 30 could be produced by other means, if desired.

It should be clearly understood, therefore, that this disclosure describes how to make and use certain examples, but the principles of the disclosure are not limited to any details of those examples. Instead, those principles can be applied to a variety of other examples using the knowledge obtained from this disclosure.

The well system 10 and associated method can have components, procedures, etc., which are similar to those used in the ESTMZ™ completion system marketed by Halliburton Energy Services, Inc. of Houston, Tex. USA. In the ESTMZ™ system, the casing 16 is perforated, the formation 20 is fractured and the annulus 28 about the completion string 23 is gravel packed as follows:

a) The sump packer 26*f* is installed and set.

b) The casing 16 is perforated (e.g., using un-illustrated wireline or tubing conveyed perforating guns).

c) The completion string 23 is installed (e.g., conveyed into the wellbore 12 on a work string 21 (see FIG. 9) and service tool).

d) Internal pressure is applied to the work string 21 to set the upper gravel packing packer 26*a*. A suitable gravel packing packer is the VERSA-TRIEVE™ packer marketed by Halliburton Energy Services, Inc., although other types of packers may be used, if desired.

e) The service tool is released from the packer 26*a*.

f) Pressure is applied to the annulus above the packer 26*a* to set all of the isolation packers 26*b-e*.

g) The service tool is displaced using the work string 21 to open the lowest valve 27.

h) The service tool is displaced to open the next higher valve 25.

i) The service tool is displaced to a fracturing/gravel packing position.

j) Fracturing/gravel packing fluids/slurries are flowed through the work string 21 and service tool, exiting the open valve 25. The fluids/slurries can enter the open valve 27 and flow through the service tool to the annulus 28 above the packer 26*a*.

k) The formation 20 is fractured, due to increased pressure applied while flowing the fluids/slurries.

l) The fluids/slurries are pumped until sand out, thereby gravel packing the annulus 28 about the well screen 24 between the open valves 25, 27.

m) The service tool is displaced to close the open valve 27, and excess proppant/sand/gravel is reversed out by applying pressure to the annulus above the packer 26*a*.

n) The service tool is displaced to close the open valve 25.

o) Steps g-n are repeated for each zone, with the work string 21 and service tool progressing in sequence from the lowermost zone to the uppermost zone.

After the uppermost zone has been stimulated and gravel packed, it would be advantageous to be able to open multiple valves 36 to thereby permit the fluid 30 to flow through the screens 24 and into the interior of the tubular string 22 for production to the surface. It would also be advantageous to be able to do so remotely, and without the need for a physical intervention into the well with, for example, a wireline, slickline or coiled tubing to shift the valves 36.

In keeping with the principles of this disclosure, the valves 36 can remain closed during the installation and fracturing/gravel packing operations, thereby preventing flow through the well screens 24 during these operations. Then, after the fracturing/gravel packing is completed, the work string 21 has been retrieved from the well and the tubular string 22 has been installed, all of the valves 36 can be opened substantially simultaneously using certain pressure manipulations described below.

It will, however, be appreciated that a number of pressure manipulations will possibly occur prior to the conclusion of the tubular string 22 installation, with the valves 36 being exposed to those pressure manipulations, and so it would be advantageous for the valves 36 to remain closed during those pressure manipulations. It is one particular benefit of the well system 10 and method of FIG. 1 that the valves 36 can remain closed while the fracturing/gravel packing and installation operations are performed, and then all of the valves 36 can be opened substantially simultaneously in response to a predefined pressure sequence.

Referring additionally now to FIGS. 2-6, a section of the completion string 23, including one example of the valve 36 which may be used in the well system 10 and method, is representatively illustrated. Of course, the completion string 23 and/or the valve 36 may be used in other well systems and methods, in keeping with the principles of this disclosure.

In this example, the valve 36 is interconnected between two of the well screens 24. Fluid 30 filtered by the screens 24 is available in respective annuli 38 at either end of the valve 36, but flow of the fluid into an interior flow passage 40 of the valve and completion string 23 is prevented by a closure member 42 in FIG. 2.

Figure 2:
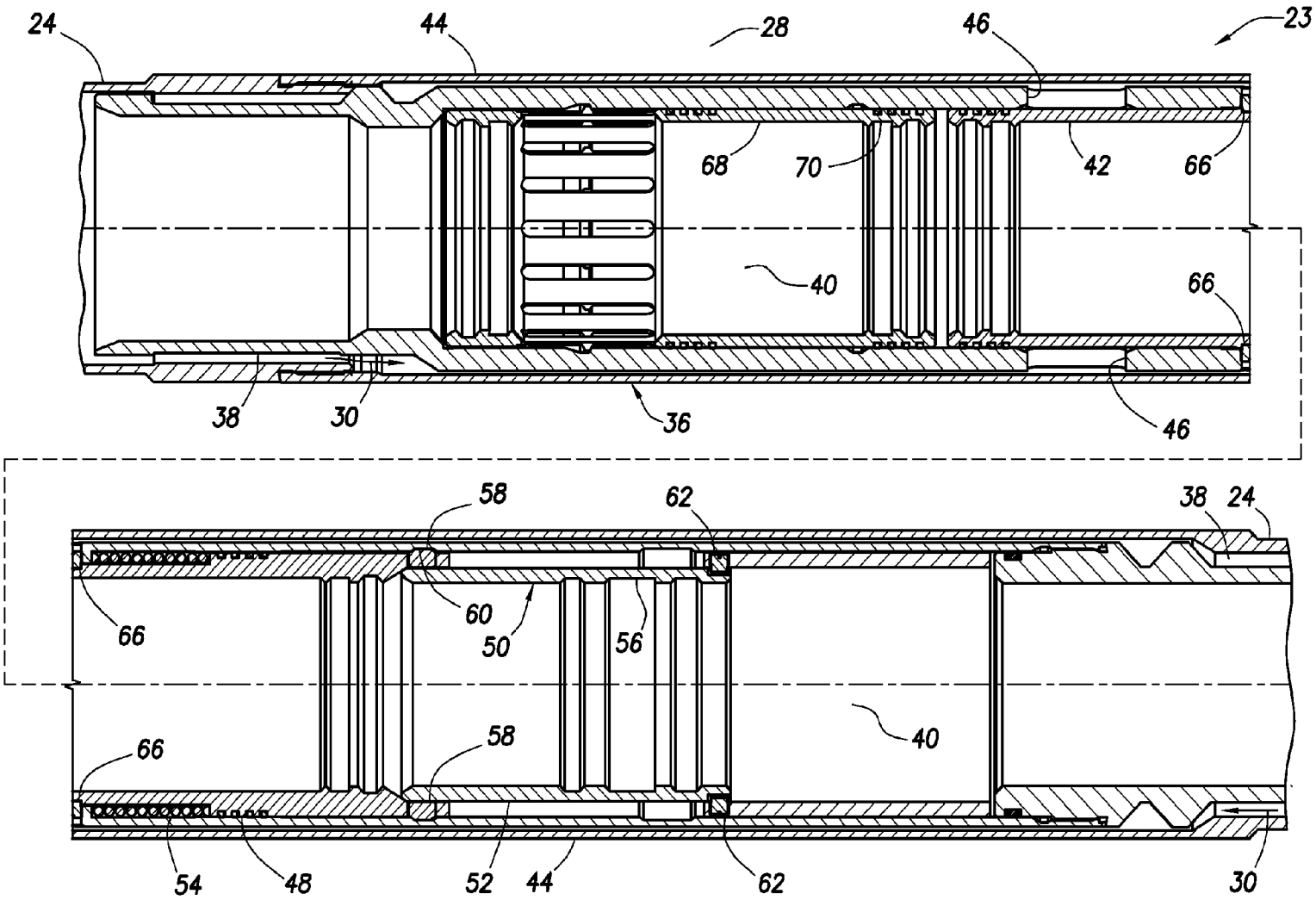
FIGS. 2-6 are representative cross-sectional views of a section of a completion string which may be used in the well system and method of FIG. 1.

As depicted in FIG. 2, the closure member 42 is in the form of a sleeve reciprocably disposed in an outer housing assembly 44, although other types of closure members (plugs, flappers, balls, etc.) could be used, if desired. The closure member 42 blocks flow through ports 46, thereby preventing communication between the annuli 38 and the flow passage 40 during the installation and fracturing/gravel packing procedures described above.

An annular piston 48 is formed integrally on the closure member 42. As viewed in FIG. 2, on its left-hand side the piston 48 is exposed to pressure in the annulus 28 external to the valve 36. On its right-hand side the piston 48 is exposed to pressure in the flow passage 40.

Thus, a pressure increase in the flow passage 40 (e.g., resulting in a pressure differential from the interior to the exterior of the valve 36) will bias the piston 48 leftward as viewed in FIG. 2. The piston 48 is biased rightward by a biasing device 54 (for example, a spring, compressed gas chamber, etc.).

A locking device 50 initially prevents any displacement of the closure device 42 relative to the ports 46. In this example, the locking device 50 includes a sleeve 52 which radially outwardly supports dogs or lugs 58 in engagement with an internal profile 60 in the housing assembly 44. Such engagement between the lugs 58 and the profile 60 prevents displacement of the closure device 42 during the installation and fracturing/gravel packing procedures described above.

Shear screws 62 prevent displacement of the sleeve 52 relative to the lugs 58. If, however, a shifting tool 64 (see FIG. 9) is engaged with a profile 56 formed internally on the sleeve 52 and a sufficient mechanical force is applied from the shifting tool to the sleeve via the profile, the shear screws 62 will shear, and the sleeve 52 will displace to the right as viewed in FIG. 2, with the sleeve thereby no longer supporting the lugs 58.

The closure device 42 is also prevented from displacing by another set of shear screws 66. After the sleeve 52 has been shifted to the right and no longer supports the lugs 58, pressure in the passage 40 can be increased to thereby shear the shear screws 66.

When a leftward biasing force on the piston 48 due to the pressure increase in the flow passage 40 increases enough to overcome the rightward biasing force exerted by the biasing device 54, plus friction and the force necessary to shear the shear screws 66, the piston 48 and closure member 42 will displace leftward from their FIG. 2 position. A subsequent decrease in the pressure in the flow passage 40 will result in the closure member 42 and piston 48 displacing to the right as viewed in FIG. 2, thereby opening the ports 46 to fluid flow.

In this description of the valve 36, a pressure increase is applied as a pressure differential from the interior of the valve (e.g., in the flow passage 40) to the exterior of the valve (e.g., in the annulus 28 surrounding the valve), for example, by increasing pressure in the tubular string 22. However, such a pressure differential could alternatively be applied by reducing pressure in the annulus 28.

Thus, a "pressure increase" and similar terms should be understood as a pressure differential increase, whether pressure is reduced or increased on the interior or exterior of the valve 36. A "pressure reduction" and similar terms should be understood as a pressure differential reduction, whether pressure is reduced or increased on the interior or exterior of the valve 36.

The valve 36 is depicted in FIG. 2 configured as installed in the well system 10 of FIG. 1. A number of pressure differential cycles can be applied to the valve 36, for example, during installation, fracturing/gravel packing and/or other operations, without causing actuation of the valve.

At the conclusion of these operations, the valve 36 can be opened by shifting the sleeve 52, increasing the pressure differential from the interior to the exterior of the valve, and then decreasing the pressure differential. Multiple valves 36 can be actuated simultaneously.

Figure 3:
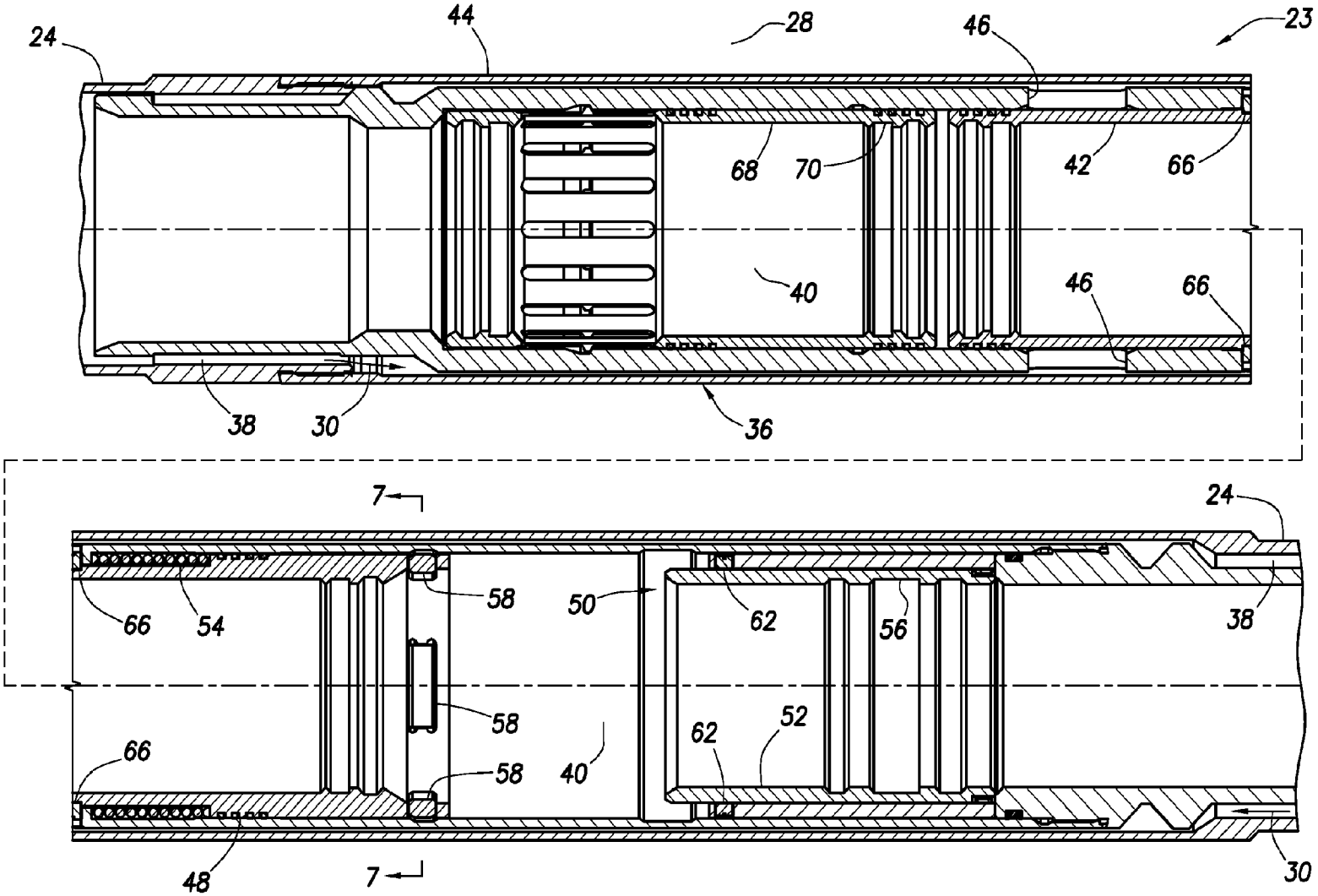

In FIG. 3, the valve 36 is depicted after the locking device 50 has been released by shifting the sleeve 52 rightward as viewed in the drawings. In this example, the sleeve 52 is displaced rightward, shearing the shear screws 62, by engaging the profile 56 with the shifting tool 64 and applying a sufficient mechanical force from the shifting tool to the sleeve via the profile 56.

Figure 7:
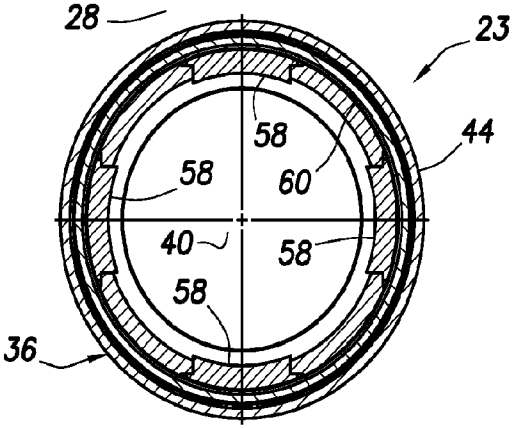
FIG. 7 is a representative cross-sectional view of the completion string, taken along line 7-7 of FIG. 3.

When the sleeve 52 is displaced to the right as viewed in FIG. 3, the lugs 58 are no longer radially outwardly supported by the sleeve, and the lugs can disengage from the profile 60 (see FIG. 7). This allows the piston 48 to displace the closure member 42 in response to a pressure differential from the passage 40 to the annulus 28, thereby shearing the shear screws 66.

Figure 4:
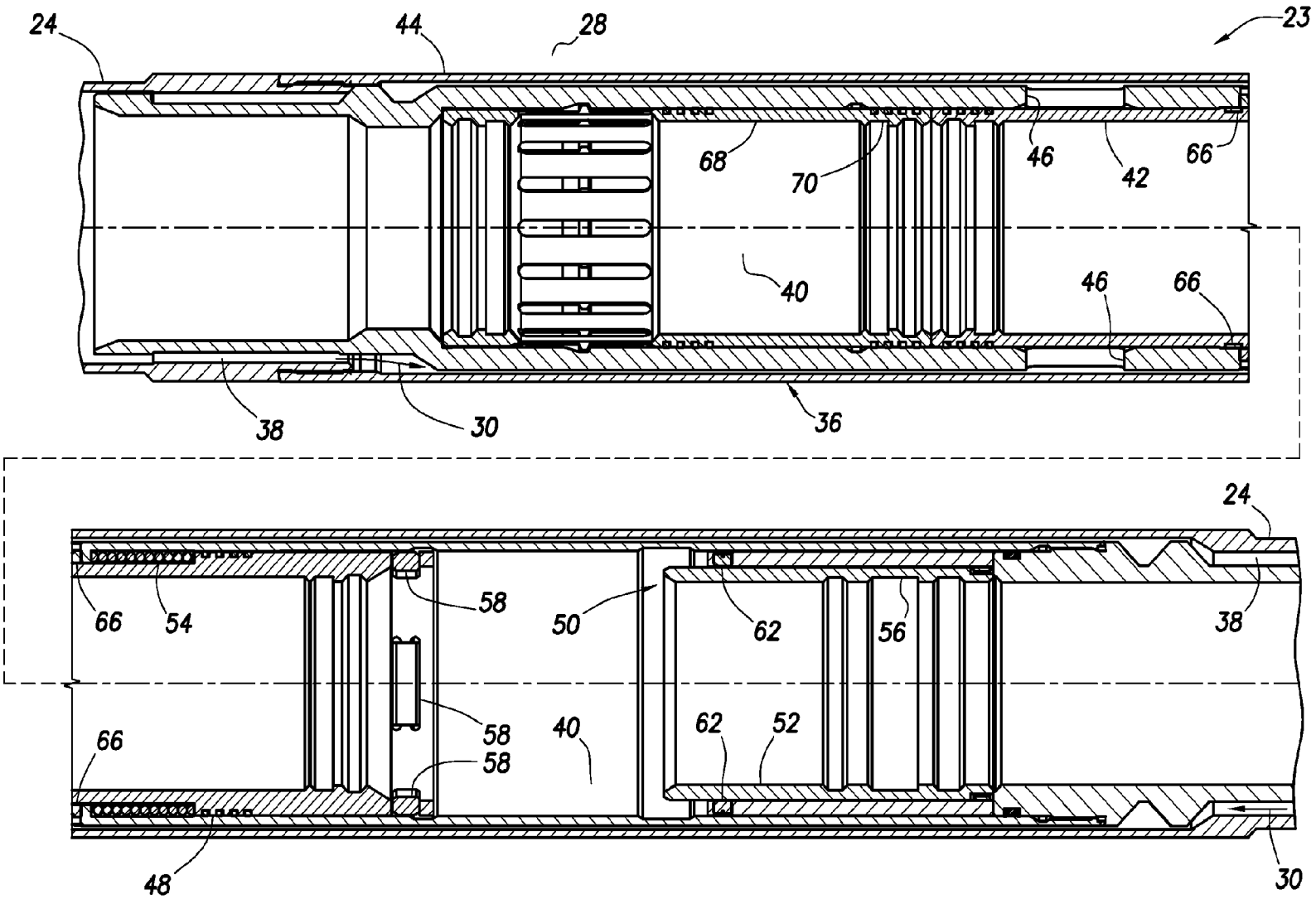

In FIG. 4, the valve 36 is depicted after the shear screws 66 have been sheared in response to a predetermined pressure differential being applied from the interior to the exterior of the valve. The closure member 42 is now displaced to the left somewhat, as viewed in FIG. 4, but the closure member still prevents fluid flow through the ports 46.

Figure 5:
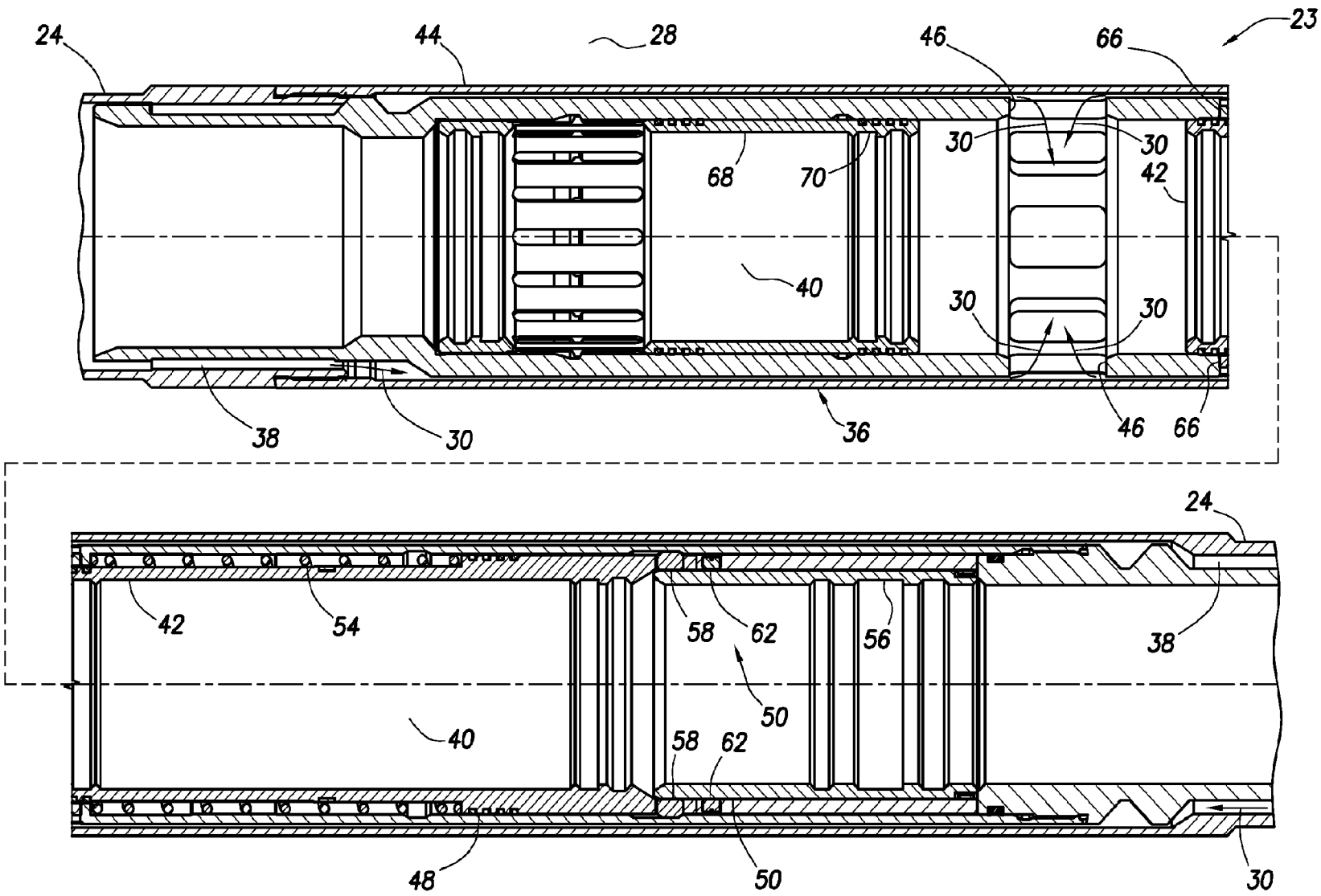

In FIG. 5, the valve 36 is depicted after the pressure differential from the interior to the exterior of the valve is reduced, for example, by reducing pressure in the flow passage 40. The closure member 42 is now displaced to the right as viewed in FIG. 5, due to the biasing force exerted by the biasing device 54 and a pressure differential from the annulus 28 to the flow passage 40 acting on the piston 48.

Due to the displacement of the closure member 42 by the piston 48, the ports 46 are no longer blocked, and the fluid 30 can now flow inwardly through the ports into the passage 40. If multiple valves 36 are installed in the completion string 23 as depicted in FIG. 1, all of the valves can be opened simultaneously in response to the pressure reduction, as described above.

Note that multiple valves 36 can be actuated simultaneously using the procedure described above. Preferably, all of the valves 36 in the well system 10 are opened when the pressure differential is reduced, so that the fluid 30 is received into the completion string 23 from all of the desired production zones of the formation 20.

It may, however, at a subsequent time be desirable to close one or more of the valves 36, for example, to prevent or mitigate gas coning 32 or water coning 34 (see FIG. 1). To close a particular valve 36, another sleeve 68 having a profile 70 formed therein can be engaged by a conventional shifting tool (not shown) and displaced to block flow through the ports 46.

Figure 6:
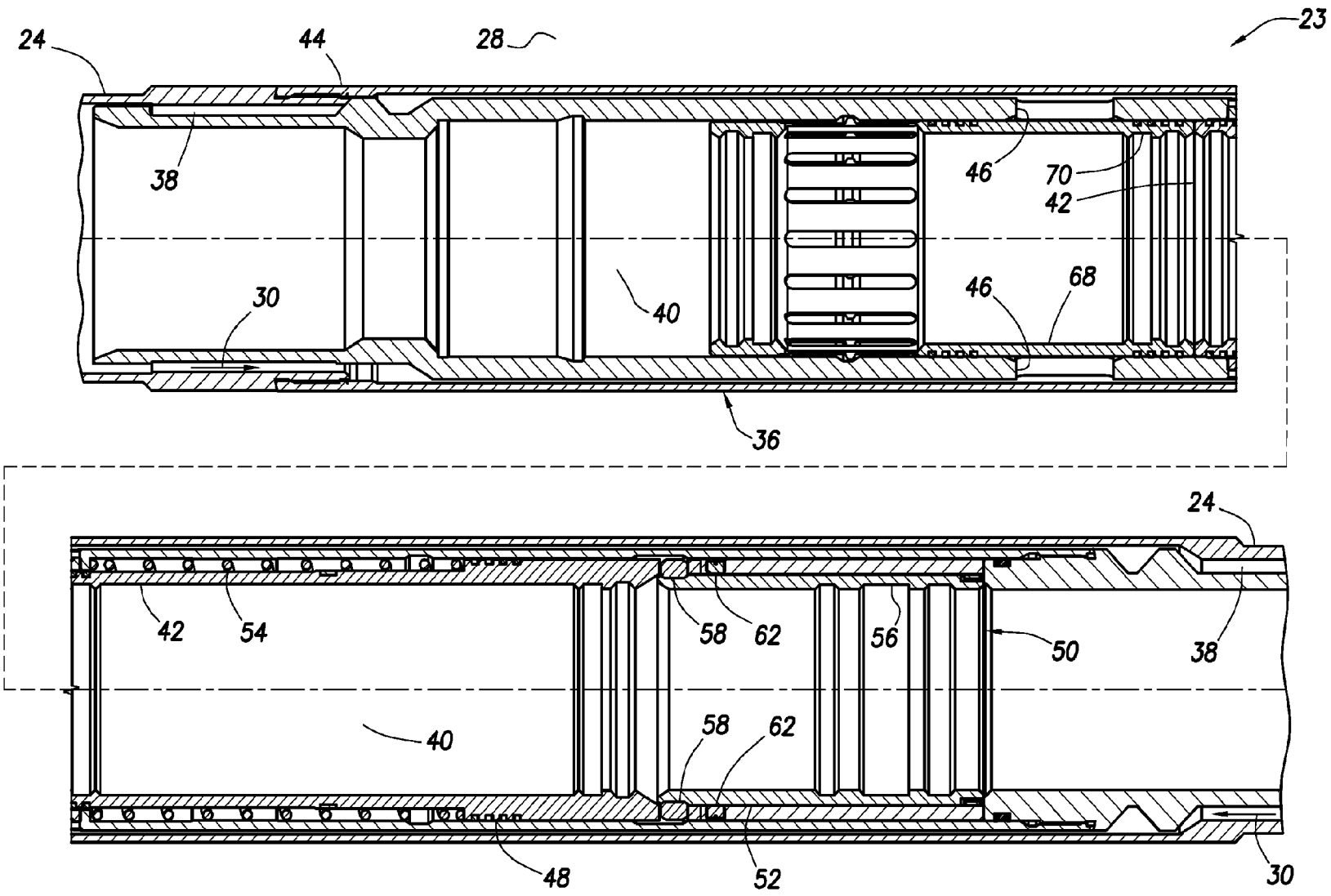

In FIG. 6, the valve 36 is depicted after the sleeve 68 has been displaced to the right, so that it now prevents flow through the ports 46. The sleeve 68 can be shifted in either direction after the closure member 42 no longer blocks flow through the ports 46, so that the sleeve can selectively permit and prevent flow through the ports as desired. The sleeve 68 can be shifted to its FIGS. 5 & 6 positions to thereby allow or block flow, respectively, through the ports 46 using, e.g., a conventional wireline, slickline or coiled tubing-conveyed shifting tool (not shown).

In FIG. 7, a cross-sectional view of the valve 36 is representatively illustrated, taken along line 7-7 of FIG. 3. This view depicts the lugs 58 being disengaged from the profile 60 upon displacement of the sleeve 52 to its unlocked position.

Figure 8:
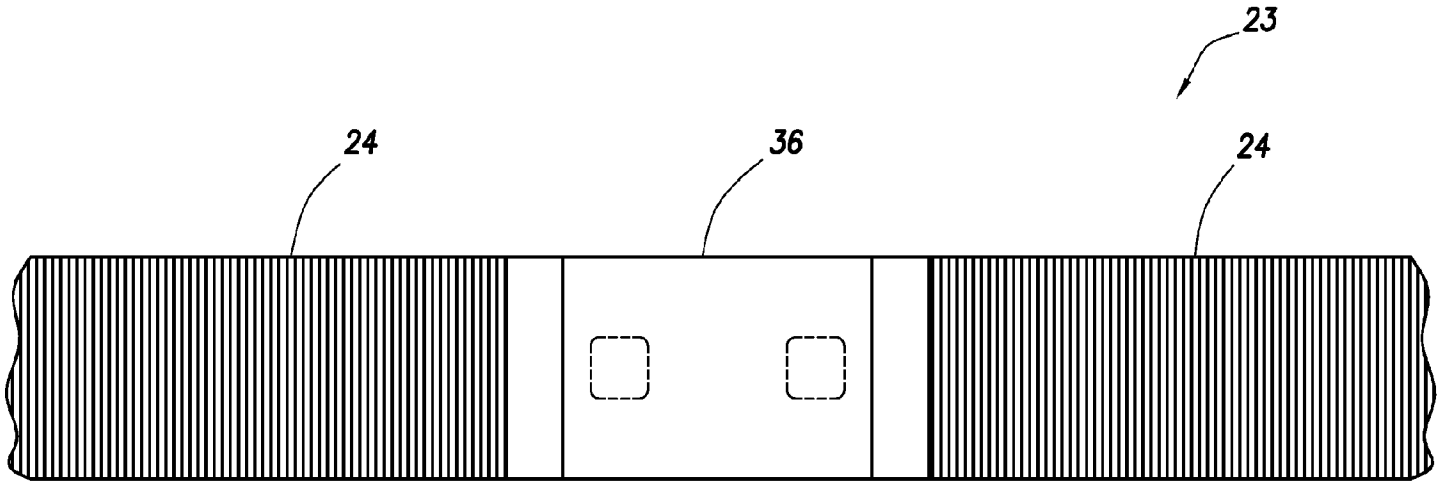
FIG. 8 is a representative side view of a section of the completion string.

In FIG. 8, the valve 36 is depicted as being interconnected between two well screens 24 as in the examples of FIGS. 2-6 described above. However, in other examples, the valve 36 is not necessarily connected between two well screens 24, and the valve can control flow through any other number of well screens, or can otherwise control flow between the interior and the exterior of the completion string 23, in keeping with the principles of this disclosure.

Figure 9:
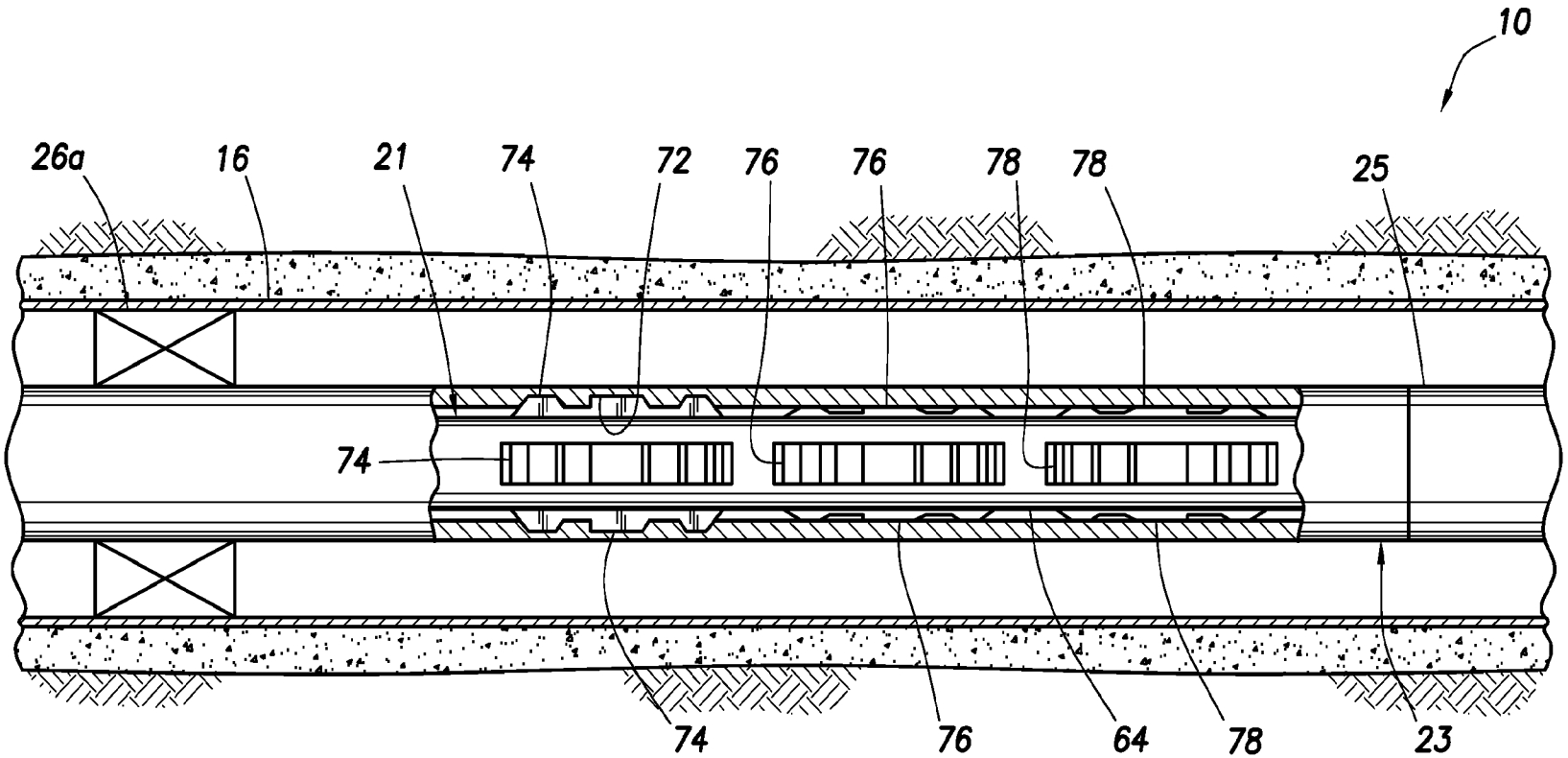
FIG. 9 is a representative partially cross-sectional view of another section of the completion string having a work string disposed therein.

In FIG. 9, the work string 21 is representatively illustrated in a portion of the completion string 23. In this view it may be seen that the work string 21 includes the shifting tool 64 which engages an internal profile 72 in the completion string 23.

In this example, the profile 72 is interconnected in the completion string 23 between the upper packer **26*a* and the uppermost valve 25. The work string 21 and shifting tool 64 are brought to this position after completion of the fracturing/gravel packing procedure described above in relation to the well system 10 of FIG. 1**.

Thus, after all of the desired zones have been fractured and/or gravel packed, the work string 21 is positioned as depicted in FIG. 9. Engagement between the shifting tool 64 and the profile 72 results from a set of shifting keys 74 on the shifting tool complementarily engaging the profile.

Mechanical force applied to the shifting tool 64 after such engagement between the keys 74 and the profile 72 causes another set of shifting keys 76 to retract, and causes yet another set of shifting keys 78 to extend outward. The keys 76 were previously used to operate the valves 25, 27 during the fracturing/gravel packing procedure, and are no longer needed after that procedure.

The keys 78 are to be used to shift the sleeves 52 to their unlocked positions as depicted in FIG. 3. After the keys 78 have been extended outward as described above, the work string 21 is lowered through the completion string 23, with the keys 78 engaging the profiles 56 and mechanically shifting the sleeves 52 to their unlocked positions in succession as the shifting tool 64 passes through each valve 36.

The work string 21 can then be retrieved from the well, the tubular string 22 can be installed, and the valves 36 can be actuated remotely by increasing a pressure differential applied to the valves (e.g., by increasing pressure applied to the tubular string, or reducing pressure in the annulus 28) sufficiently to shear the shear screws 66 as depicted in FIG. 4, and then decreasing the pressure differential applied to the valves so that the pistons 48 shift the closure members 42 to their open positions as depicted in FIG. 5.

It may now be fully appreciated that this disclosure provides a number of improvements to the art. The valve 36 can be exposed to any number of pressure cycles without actuating. However, after releasing the locking device 50 (e.g., by shifting the sleeve 52 to its unlocked position), the valve 36 can be conveniently actuated by increasing an applied pressure differential, and then decreasing the applied pressure differential. Multiple valves 36 can be substantially simultaneously actuated in this manner.

The above disclosure provides to the art a method of actuating multiple valves 36 in a well. The method can include applying at least one pressure cycle to the valves 36 without causing actuation of any of the valves 36, and then simultaneously reducing pressure applied to the valves 36, thereby actuating the valves 36.

Actuating the valves 36 can include opening the valves 36. Actuating the valves 36 may include permitting fluid flow between an interior and an exterior of a completion string 23.

The method may include, between the applying and pressure reducing steps, increasing pressure applied to the valves 36. Increasing pressure can include releasing a closure member 42, thereby permitting the closure member 42 to displace relative to a port 46.

Applying at least one pressure cycle may include varying pressure in an internal flow passage 40 of the valves 36.

Reducing pressure may include increasing a pressure differential from an exterior to an interior of each valve 36.

The method can include, prior to reducing pressure, releasing a locking device 50 of each valve 36 which prevents actuation of the valve 36. Releasing the locking device 50 may include engaging a shifting tool 64 with a profile 56 formed internally on the locking device 50 of each valve 36.

The shifting tool 64 may comprise multiple sets of shifting keys, a first set 74 which, when engaged, is operative to retract a second set 76 and extend a third set 78 which engages the profile 56.

Another method of actuating multiple valves 36 in a well is described above, with the method comprising: applying at least one pressure cycle to the valves 36 without causing actuation of any of the valves 36, then releasing a locking device 50 of each valve 36 which prevents actuation of each valve 36, and then reducing pressure applied to the valves 36, thereby actuating the valves 36.

Also described above is a remotely operated valve 36 for use with a subterranean well. The valve 36 can include a port 46 which provides for fluid communication between an exterior and an interior of the valve 36, a closure member 42 which selectively permits and prevents fluid flow through the port 46, the closure member 42 permits flow through the port 46 in response to a decrease in a pressure differential from the interior to the exterior of the valve 36, and a locking device 50 which prevents displacement of the closure member 42, the locking device 50 being released in response to mechanical force applied to the locking device 50.

The locking device 50 may comprise a sleeve 52 having an internal profile 56 formed thereon. The internal profile 56 may be engaged by a shifting tool 64 which comprises multiple sets of shifting keys, a first set 74 which, when engaged, is operative to retract a second set 76 and extend a third set 78 which engages the profile 56.

The closure member 42 may be released for displacement relative to the port 46 in response to, following release of the locking device 50, an increase in the pressure differential prior to the decrease in the pressure differential.

The valve 36 may receive the fluid 30 from a well screen 24.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A remotely operated valve for use with a subterranean well, the valve comprising:

a port which provides for fluid communication between an exterior and an interior of the valve;

a closure member which selectively permits and prevents fluid flow through the port, the closure member permits flow through the port in response to a decrease in a pressure differential from the interior to the exterior of the valve; and a locking device which prevents displacement of the closure member, the locking device being releasable in response to mechanical force applied to the locking device, wherein the closure member is released for displacement relative to the port in response to, following release of the locking device, an increase in the pressure differential prior to the decrease in the pressure differential.

2. The valve of claim 1, wherein the locking device comprises a sleeve having an internal profile formed thereon.

3. The valve of claim 2, wherein the internal profile is engaged by a shifting tool which comprises multiple sets of shifting keys, a first set which, when engaged, is operative to retract a second set and extend a third set which engages the profile.

4. The valve of claim 1, wherein the valve receives the fluid from a well screen.

5. A remotely operated valve for use with a subterranean well, the valve comprising:

a port which provides for fluid communication between an exterior and an interior of the valve;

a closure member which selectively permits and prevents fluid flow through the port, the closure member permits flow through the port in response to a decrease in a pressure differential from the interior to the exterior of the valve; and a locking device which prevents displacement of the closure member, the locking device being releasable in response to mechanical force applied to the locking device, wherein the locking device comprises a sleeve having an internal profile formed thereon, wherein the internal profile is engaged by a shifting tool which comprises multiple sets of shifting keys, a first set which, when engaged, is operative to retract a second set and extend a third set which engages the profile, and wherein the locking device comprises a sleeve having an internal profile formed thereon.

6. The valve of claim 5, wherein the valve receives the fluid from a well screen.

7. The valve of claim 5, wherein the closure member is released for displacement relative to the port in response to, following release of the locking device, an increase in the pressure differential prior to the decrease in the pressure differential.

* * * * *